US010096281B2

(12) United States Patent
An

(10) Patent No.: US 10,096,281 B2
(45) Date of Patent: Oct. 9, 2018

(54) DISPLAY DEVICE, DRIVING METHOD THEREOF, AND TIMING CONTROLLER THEREOF

(71) Applicant: LG Display Co., Ltd., Seoul (KR)

(72) Inventor: JaeSung An, Seoul (KR)

(73) Assignee: LG Display Co., Ltd., Seoul (KR)

( * ) Notice: Subject to any disclaimer, the term of this patent is extended or adjusted under 35 U.S.C. 154(b) by 440 days.

(21) Appl. No.: 14/842,284

(22) Filed: Sep. 1, 2015

(65) Prior Publication Data

US 2016/0063910 A1 Mar. 3, 2016

(30) Foreign Application Priority Data

Sep. 3, 2014 (KR) ..... 10-2014-0117037

(51) Int. Cl.
*G09G 3/3233* (2016.01)

(52) U.S. Cl.
CPC ... *G09G 3/3233* (2013.01); *G09G 2300/0842* (2013.01); *G09G 2320/0295* (2013.01); *G09G 2320/045* (2013.01)

(58) Field of Classification Search
USPC ..... 345/691
See application file for complete search history.

(56) References Cited

U.S. PATENT DOCUMENTS

2008/0252568 A1* 10/2008 Kwon ..... G09G 3/3233 345/76
2011/0096106 A1 4/2011 Nomaguchi et al.
2011/0227505 A1* 9/2011 Park ..... H05B 33/0896 315/297
2012/0056870 A1 3/2012 Koh
2014/0062843 A1* 3/2014 Yang ..... G09G 3/3233 345/76

FOREIGN PATENT DOCUMENTS

CN 102568420 A 7/2012
CN 103794184 A 5/2014

OTHER PUBLICATIONS

Chinese First Office Action, Chinese Application No. 201510553057.9, dated Aug. 1, 2017, 14 pages.

* cited by examiner

*Primary Examiner* — Jason C Olson
(74) *Attorney, Agent, or Firm* — Fenwick & West LLP

(57) ABSTRACT

A display device, a driving method thereof, and a timing controller thereof able to prevent image defects, such as image insensitiveness, non-uniform luminance, and gradation abnormality, which would otherwise occur when sensing data are not ordinarily acquired from data sequentially transmitted from a plurality of sensing configurations are disclosed.

15 Claims, 10 Drawing Sheets

DISPLAY DEVICE, DRIVING METHOD THEREOF, AND TIMING CONTROLLER THEREOF

CROSS REFERENCE TO RELATED APPLICATION

This application claims priority from and the benefit under 35 U.S.C. § 119(a) of Korean Patent Application Number 10-2014-0117037 filed on Sep. 3, 2014, which is hereby incorporated by reference for all purposes as if fully set forth herein.

BACKGROUND

Related Field

The present disclosure relates to a display device, a driving method thereof, and a timing controller thereof.

Description of Related Art

In response to the development of the information society, there has been increasing demand for various types of display devices able to display images. Various display devices, such as liquid crystal display (LCD) devices, plasma display panels (PDPs), and organic light-emitting display devices, are in common use.

Degradations occur in a display panel of such a display device along with the lapse of driving time. This may consequently lower the uniformity of display characteristics of the display panel.

Degradations in the display panel decreasing the uniformity of the display panel are mainly caused by changes and shifts of the unique characteristics of circuit devices disposed on each subpixel of the display panel and different unique characteristics of the circuit devices.

The circuit devices disposed on each subpixel of the display panel may include at least one transistor. For example, when the display panel is an organic light-emitting display panel, the circuit devices disposed on each subpixel may include a single organic light-emitting diode (OLED), two transistors, one or more capacitors, and the like.

The unique characteristics of the circuit device may include the threshold voltages, mobility, and the like of the transistors, in addition to the threshold voltage of the OLED.

When the display characteristics of the display panel degrade due to the changes and shifts of the unique characteristics of any circuit device and the different unique characteristics of the circuit devices as mentioned above, the degraded characteristics can be compensated.

In order to apply these compensation technologies, a plurality of sensing configurations generate sensing data including information on characteristics of the display panel and sequentially transmit the sensing data to a compensation configuration. The compensation configuration performs a compensation function using the sensing data sequentially received from the plurality of sensing configurations and an internal clock signal.

However, the internal clock signal used by the compensation configurations may not be properly synchronized with the sensing data sequentially transmitted from the plurality of sensing configurations for various reasons.

As a result, the compensation configuration cannot properly acquire the sensing data, thereby failing to perform the compensation function. Consequently, image defects, such as image insensitiveness, non-uniform luminance, and gradation abnormality, can occur.

SUMMARY

A display device, a driving method thereof, and a timing controller thereof able to prevent image defects occurring when sensing data are not ordinarily acquired from data sequentially transmitted from a plurality of sensing configurations are disclosed.

In one embodiment, a display device includes: a plurality of sensors each sequentially transmitting data including a transfer start code and sensing data; a sensing data acquirer acquiring the sensing data from the data sequentially transmitted from each of the plurality of sensors in response to a synchronized clock signal; and a compensator performing a compensation process based on the sensing data.

The synchronized clock signal may have a clock edge evading entire transition periods of the data sequentially transmitted from the plurality of sensors.

In one or more embodiments, a method of driving a display device includes: receiving data from each of a plurality of data driver integrated circuits; determining whether or not a transfer start code in the data received from each of the plurality of data driver integrated circuits is recognizable; responsive to determining that the transfer start code is not recognizable, changing the clock signal until the transfer start code is recognizable; responsive to determining that the transfer start code is recognizable, acquiring sensing data from the data received from each of the plurality of data driver integrated circuits; and performing a compensation process based on the sensing data.

In one or more embodiments, a method of driving a display device includes receiving data from a plurality of data driver integrated circuits; determining whether or not a clock edge of a clock signal evades entire transition periods of the data received from the plurality of data driver integrated circuits; responsive to determining that the clock edge of the clock signal is present in the transition period the data received from at least one data driver integrated circuit among the plurality of data driver integrated circuits, changing the clock signal such that a clock edge thereof evades the entire transition periods of the data received from the plurality of data driver integrated circuits; responsive to determining that the clock edge of the clock signal evades the entire transition periods of the data received from the plurality of data driver integrated circuits, acquiring sensing data from the data received from the plurality of data driver integrated circuits; and performing a compensation process based on the sensing data.

At the operation of changing the clock signal, the clock signal may be changed while the clock parameter is being shifted by a predetermined bit.

In one or more embodiments, a timing controller includes: a receiver receiving data from a plurality of data driver integrated circuits; a sensing data acquirer acquiring sensing data from the data received from the plurality of data driver integrated circuits in response to a synchronized clock signal; and a compensator performing a compensation process based on the sensing data acquired by the sensing data acquirer.

The synchronized clock signal may have a clock edge evading entire transition periods of the data sequentially transmitted from the plurality of sensors.

In one or more embodiments, a timing controller includes: a receiver receiving data having different transition periods from a plurality of data driver integrated circuits; a sensing data acquirer acquiring sensing data from the data having different transition periods; and a compensator performing a compensation process based on the sensing data acquired by the sensing data acquirer.

According to the present embodiments as set forth above, it is possible to prevent image defects, such as image insensitiveness, non-uniform luminance, and gradation abnormality, which would otherwise occur when sensing data are not ordinarily acquired from data sequentially transmitted from the plurality of sensing configurations.

In addition, according to the present embodiments, even in the case in which data sequentially transmitted from the plurality of sensing configurations have phase differences, it is possible to ordinarily acquire sensing data from the data sequentially transmitted from the plurality of sensing configurations, thereby successfully performing compensation.

Furthermore, according to the present embodiments, it is possible to ordinarily acquire sensing data from data sequentially transmitted from the plurality of sensing configurations using a clock signal synchronized with the entire data sequentially transmitted from the plurality of sensing configurations, thereby successfully performing compensation.

In addition, according to the present embodiments, it is possible to reliably generate a synchronized clock signal by shifting a clock parameter by a predetermined bit, whereby the clock signal synchronized with entire data sequentially transmitted from the plurality of sensing configurations is generated.

BRIEF DESCRIPTION OF THE DRAWINGS

The above and other objects, features and advantages of the present disclosure will be more clearly understood from the following detailed description when taken in conjunction with the accompanying drawings, in which.

DETAILED DESCRIPTION

Figure 1:
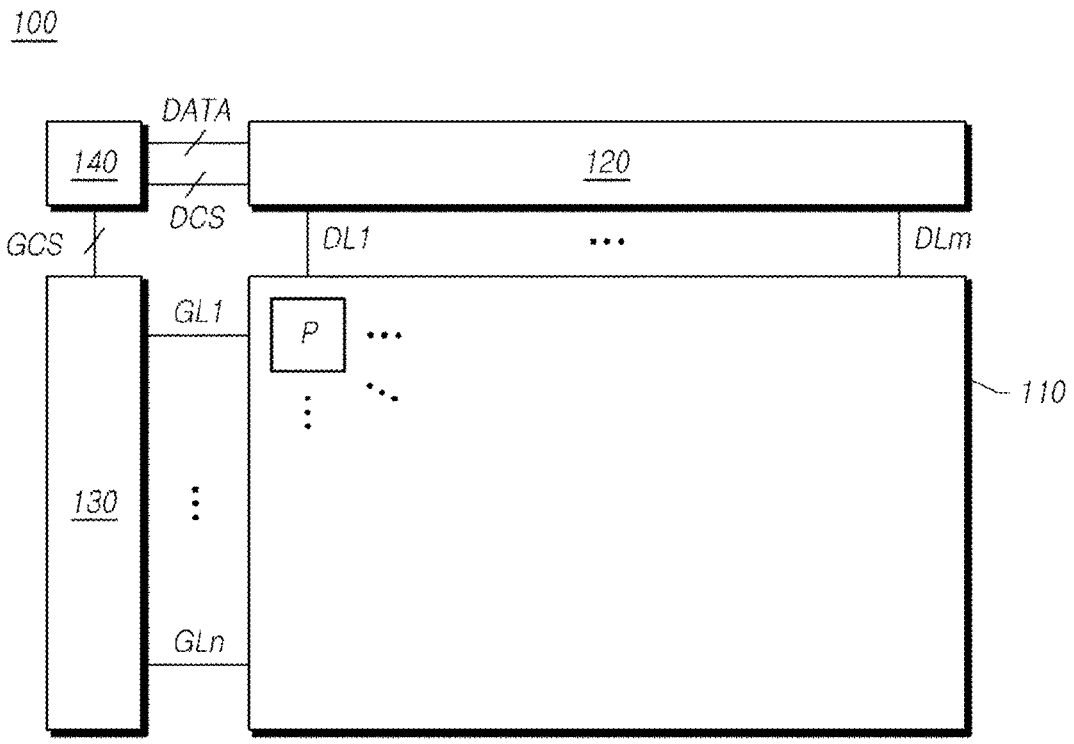
FIG. 1 is a schematic system configuration diagram illustrating a display device according to present embodiments.

Reference will now be made in detail to present embodiments, examples of which are illustrated in the accompanying drawings. Throughout this document, reference should be made to the drawings, in which the same reference numerals and signs will be used to designate the same or like components. In the following description of the present disclosure, detailed descriptions of known functions and components incorporated herein will be omitted in the case that the subject matter of the present disclosure may be rendered unclear thereby.

It will also be understood that, while terms such as "first," "second," "A," "B," "(a)" and "(b)" may be used herein to describe various elements, such terms are only used to distinguish one element from another element. The substance, sequence, order or number of these elements is not limited by these terms. It will be understood that when an element is referred to as being "connected to" or "coupled to" another element, not only can it be "directly connected" or "coupled to" the other element, but it can also be "indirectly connected or coupled to" the other element via an "intervening" element. In the same context, it will be understood that when an element is referred to as being formed "on" or "under" another element, not only can it be directly formed on or under another element, but it can also be indirectly formed on or under another element via an intervening element.

FIG. 1 is a schematic system configuration diagram illustrating a display device according to present embodiments.

Referring to FIG. 1, the display device 100 according to the present embodiments includes: a display panel 110 on which m number of data lines DL1 to DLm (where m is a natural number) and n number of gate lines GL1 to GLn (where n is a natural number); a data driver 120 driving the m number of data lines DL1 to DLm; a gate driver 130 sequentially driving the n number of gate lines GL1 to GLn; and a timing controller 140 controlling the data driver 120 and the gate driver 130.

On the display panel 110, a single subpixel P is formed at every point in which a single data line intersects one or more gate lines. Three subpixels including a red subpixel (R), a green subpixel (G), and a blue subpixel (B) or four subpixels including a red subpixel (R), white subpixel (W), a green subpixel (G), and a blue subpixel (B) form a single pixel.

The timing controller 140 starts scanning based on the timing set by each frame, converts video data input via an interface into a data signal format readable by the data driver 120, outputs the converted video data, and regulates data driving at an appropriate point of time according to the scanning.

The timing controller 140 can output a variety of control signals, such as a data control signal (DCS) and a gate control signal (GCS), in order to control the data driver 120 and the gate driver 130.

The gate driver 130 sequentially drives the n number of gate lines GL1 to GLn by sequentially sending a scanning signal having an on or off voltage thereto under the control of the timing controller 140.

Under the control of the timing controller 140, the data driver 120 drives the m number of data lines DL1 to DLm by saving the input video data in a memory (not shown), converting the corresponding video data to analog data voltages when a specific gate line is opened, and subsequently supplying the analog data voltages to the m number of data lines D1 to Dm.

The data driver 120 includes a plurality of data driver integrated circuits (ICs) (herein also referred to as the "source driver ICs"). Each of the plurality of data driver ICs may be connected to the bonding pads of the display panel 110 by tape-automated bonding (TAB) or chip-on-glass (COG) bonding, may be directly disposed on the display panel 110, or in some cases, may be integrated with the display panel 110, forming a portion of the display panel 110.

The gate driver 130 is positioned on one side of the OLED display panel 110, as illustrated in FIG. 1. Depending on the driving method, the gate driver 130 may be divided into two sections, positioned on both sides of the OLED display panel 110.

In addition, the gate driver 130 includes a plurality of gate driver ICs. Each of the plurality of gate driver ICs may be connected to the bonding pads of the OLED display panel 110 by tape-automated bonding (TAB) or chip-on-glass (COG) bonding, may be implemented as a gate-in-panel (GIP)-type IC directly disposed on the OLED display panel 110, or in some cases, may be integrated with the OLED display panel 110, forming a portion of the OLED display panel 110.

The display device 100 simplified in FIG. 1 may be implemented as one selected from, but is not limited to, a liquid crystal display (LCD) device, a plasma display device, and an organic light-emitting diode (OLED) display device.

Circuit devices, such as a transistor and a capacitor, are formed on each of the subpixels P disposed on the display panel 110. For example, when the display panel 110 is an OLED panel, circuit devices including an OLED, two or more transistors, and one or more capacitors are formed on each of the subpixels P.

The circuit device, such as the transistor, formed on each of the subpixels P of the display panel 110 has unique characteristics.

For example, the transistor has unique characteristics, such as a threshold voltage Vth and mobility.

The unique characteristics of transistors may differ, leading to differences in the luminance of the subpixels.

In particular, the transistor may suffer from degradations in performance along with the lapse of driving time. Variations in the unique characteristics among the driving transistors may increase depending on the different degrees of degradation, thereby further increasing differences in the luminance of the subpixels.

Accordingly, the display device 100 according to the present embodiments provides a sensing function of sensing the unique characteristics (e.g. the threshold voltage and mobility) of the circuit devices, such as a transistor, disposed on each of the subpixels, and a data compensation function of changing data to be supplied to each of the subpixels in order to compensate for variations in the unique characteristics among the circuit devices, i.e., variations in the luminance among the subpixels, based on the sensing result (sensing data) obtained from the unique characteristics of the circuit devices.

Hereinafter, a subpixel structure for a sensing function will be illustrated with reference to FIG. 2.

Figure 2:
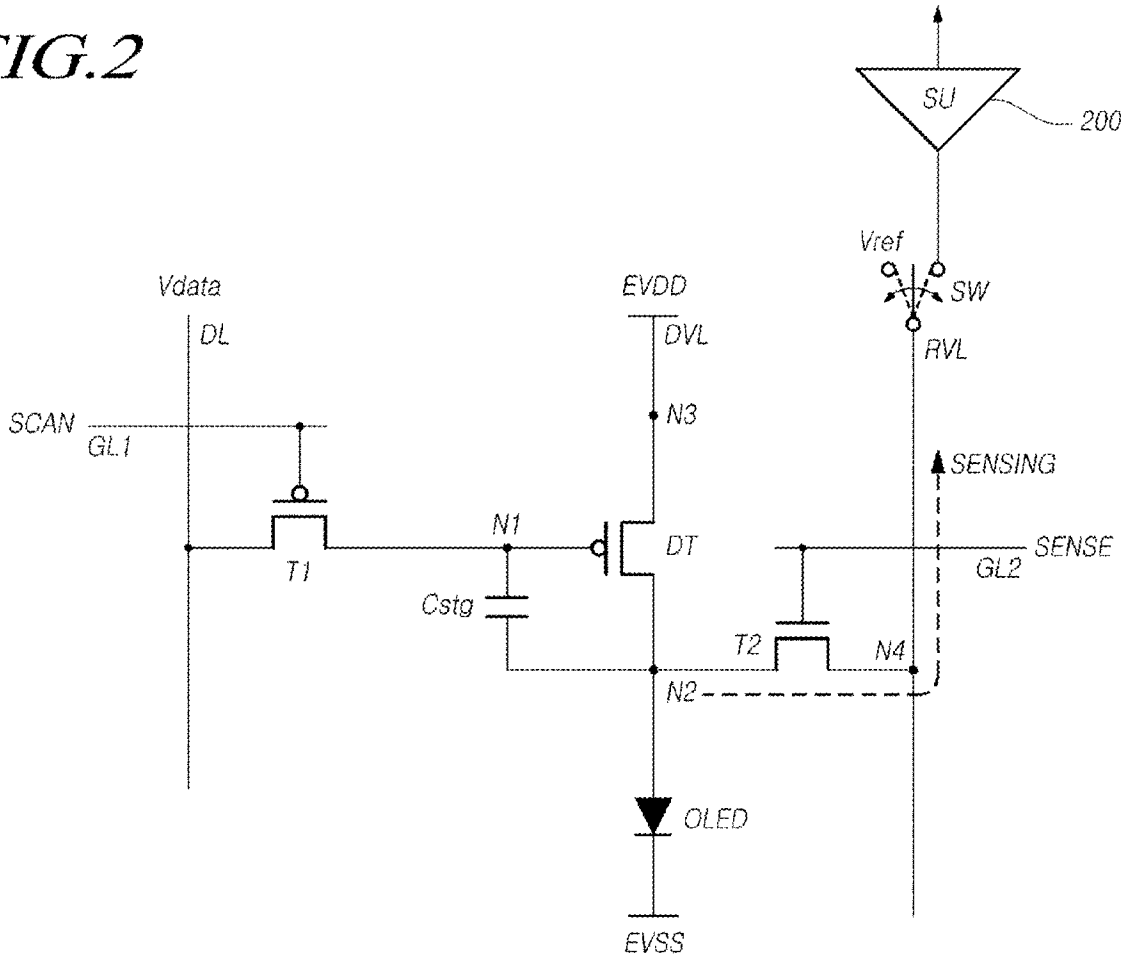
FIG. 2 is a circuit diagram illustrating an exemplary subpixel structure of the OLED display device according to the present embodiments.

FIG. 2 is a circuit diagram illustrating an exemplary subpixel structure in the case in which the display panel 110 according to the present embodiments is an OLED display panel.

Referring to FIG. 2, each of the subpixels has a 3T1C structure including three transistors DT, T1, and T2 and a single capacitor Cstg in order to drive a single OLED.

Referring to FIG. 2, the driving transistor DT is connected between a third node N3 to which a driving voltage EVDD supplied from a driving voltage line DVL is applied and the OLED, thereby driving the OLED.

The first transistor T1 is controlled by a first scanning signal supplied from a first gate line GL1, and is connected between a data line DL through which a data voltage Vdata is supplied and a first node N1 (a gate node) of the driving transistor DT. Here, the first transistor T1 is also referred to as a switching transistor.

The storage capacitor Cstg is connected between the first node N1 and a second node N2 of the driving transistor DT, and maintains a constant voltage during the period of a single frame.

The second transistor T2 is controlled by a second scanning signal supplied from a second gate line GL2, and is connected between a fourth node N4 to which a reference voltage Vref supplied from a reference voltage line RVL is applied and the second node N2 of the driving transistor DT. Here, the second transistor T2 is also referred to as a sensing transistor.

A switch SW is connected to the reference voltage line RVL.

The switch SW switches the reference voltage Vref to be supplied to the reference voltage line RVL or connects a sensor (SU) 200 to the reference voltage line RVL, in response to a switching timing control signal. Here, the sensor 200 may be implemented as, for example, an analog-to-digital converter (ADC).

In the state in which the second transistor T2 is turned on, when the switch SW connects the sensor 200 to the reference voltage line RVL, the sensor 200 can sense a voltage of the second node N2 of the driving transistor DT.

Here, the reference voltage line RVL corresponds to a sensing line allowing the voltage of the second node N2 of the driving transistor DT to be sensed.

The switching timing control signal as mentioned above is a signal controlling the switching (on/off) operation in order to set the voltage of the second node N2 of the driving transistor DT according to the driving operation of display mode or sensing mode, and can be output by the timing controller 140.

A single reference voltage line RVL corresponding to the sensing line as mentioned above may be formed on a single subpixel column, or may be formed on two, three, or four subpixel rows.

For example, when a pixel has an RWGB pixel structure, including a red subpixel (R), a white subpixel (W), a green subpixel (G), and a blue subpixel (B), a single reference voltage line RVL may be formed between a column of white subpixels (W) and a column of green subpixels (G).

A single sensor 200 is connected to a single sensing line, i.e., a single reference voltage line RVL.

A method of sensing the unique characteristics (e.g., the threshold voltage and mobility) of the driving transistor DT in each of the subpixels will be briefly described. Predetermined voltages Vdata and Vref are applied to the first node N1 (gate node) and the second node N2 (source node) of the driving transistor DT. The voltage of the second node N2 of the driving transistor DT is boosted by floating the second node N2 of the driving transistor DT. Afterwards, each of the sensors 200 senses the threshold voltage or mobility of the driving transistor DT by sensing the saturated voltage of the second node N2 of the driving transistor DT (a voltage Vdata-Vth corresponding to the difference between the voltage Vdata of the first node N1 and the threshold voltage) or by sensing a change in the voltage of the second node N2 of the driving transistor DT.

Each of the sensors 200 generates sensing data including sensed data and transmits the sensing data to a compensating configuration. The compensating configuration determines an amount of video data to be compensated by referring to the sensing data, compensates the video data to be supplied to each of the subpixels according to the determined amount to be compensated, and transmits the compensated video data to a data driver IC (DIC). Then, the data driver IC converts the compensated video data into an analog data voltage Vdata and outputs the analog data voltage Vdata to a corresponding data line.

Hereinafter, the sensor 200 and the compensating configuration as described above will be described in greater detail.

Figure 3:
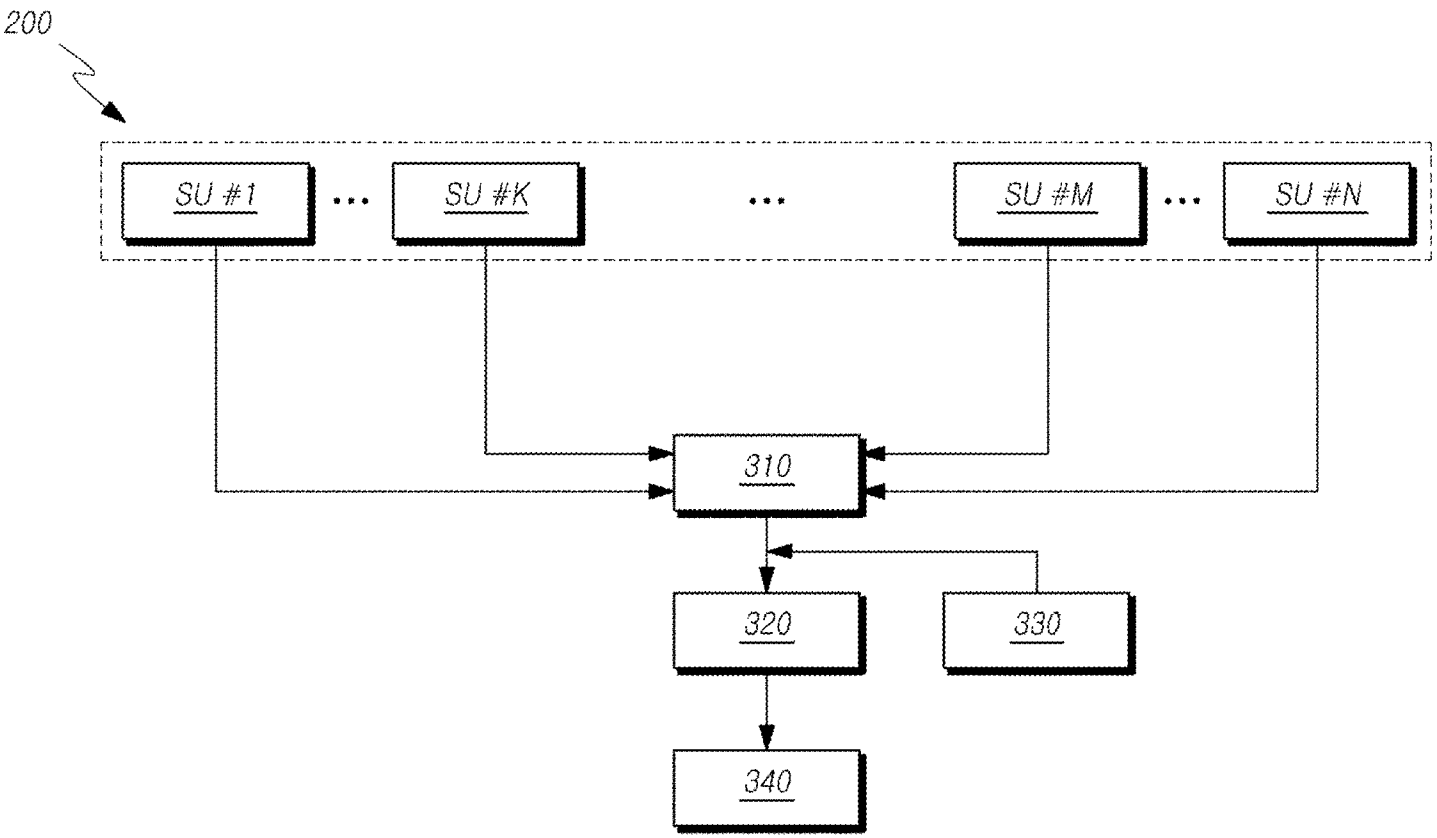
FIG. 3 is a block diagram illustrating a sensing and compensation system of the display device according to the present embodiments.

FIG. 3 is a block diagram illustrating a sensing and compensation system of the display device 100 according to the present embodiments.

Referring to FIG. 3, the sensing and compensation system of the display device 100 according to the present embodiments includes: N number of sensors 200 (SU #1 . . . SU #K . . . SU #M . . . SU #N, where 2≤N≤m) sequentially transmitting data Data containing a transfer start (TS) code and sensing data; a sensing data acquirer 320 acquiring the sensing data from the data Data sequentially transmitted from the N number of sensors 200 in response to a synchronized clock signal; and a compensator 340 performing a compensation process (also herein referred to as data compensation, subpixel compensation, or luminance compensation) based on the sensing data.

The synchronized clock signal as mentioned above is a clock signal synchronized with the data Data sequentially transmitted from the N number of sensors 200. The clock edge of the synchronized clock signal evades the entire transition periods of the data sequentially transmitted from the N number of sensors 200. The clock edge is a point in which the voltage level of the clock signal changes, for example, from a low level to a high level.

As described above, it is possible to ordinarily and reliably acquire the data Data sequentially transmitted from the plurality of sensors 200 using the data Data sequentially transmitted from the plurality of sensors 200 and the "synchronized clock signal." Consequently, the compensation process can be properly performed, thereby preventing image defects, such as image insensitiveness, non-uniform luminance, and gradation abnormality.

Each of the plurality of sensors 200 may be included in a corresponding data driver IC among the plurality of data driver ICs of the data driver 120. In this case, each of the plurality of sensors 200 may be an analog-to-digital converter (ADC), an internal component of the corresponding data driver IC converting an analog voltage into a digital format.

That is, in response to a sampling start signal (SAM) transmitted from the timing controller 140, each of the plurality of sensors 200 samples a voltage of a sensing node (N2 in FIG. 2) of the corresponding subpixel, and converts the sampled voltage into digital bits, thereby forming data in the form of ADC data.

Since each of the plurality of sensors 200 may be implemented as an ADC within the corresponding data driver IC as described above, each of the plurality of sensors 200 can transmit digital data to the timing controller 140. Hence, the timing controller 140 may not perform analog-to-digital conversion when recognizing the sensing data in the received data, because the plurality of sensors 200 can perform the analog-to-digital conversion.

In addition, the timing controller 140 may also include the sensing data acquirer 320 and the compensator 340.

When each of the plurality of sensors 200 is included in the corresponding data driver IC, and the sensing data acquirer 320 and the compensator 340 are included in the timing controller 140, each of the plurality of sensors 200 can transmit the data, including the TS code and the sensing data, in the form of ADC data to the timing controller 140.

As described above, each of the plurality of sensors 200 is included in the corresponding data driver IC, and the sensing data acquirer 320 and the compensator 340 are included in the timing controller 140. It is therefore possible to reduce the number of components and efficiently realize a sensing function and a compensation function (including a sensing data acquiring function) in association with the existing functions of the data driver ICs and the timing controller 140.

Figure 4:
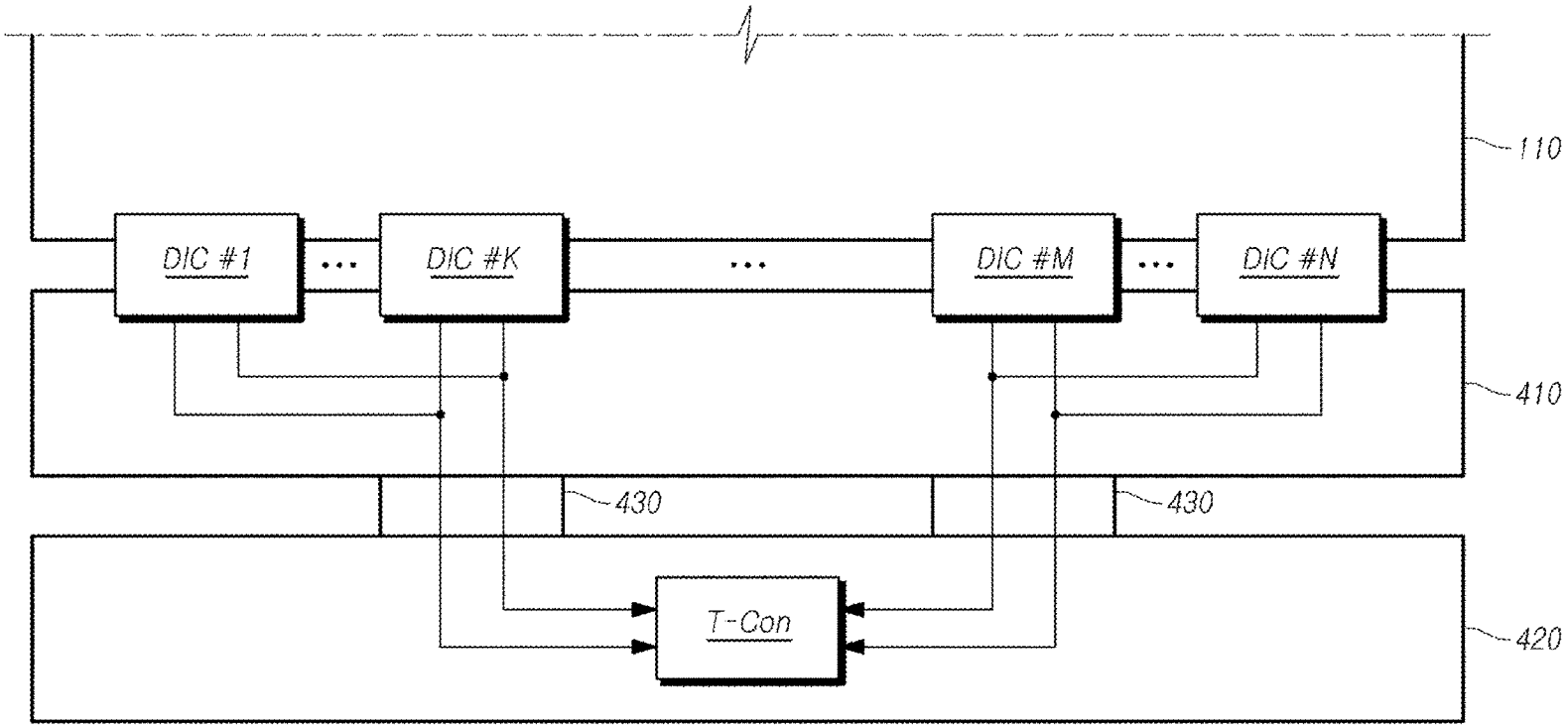
FIG. 4 is another block diagram illustrating the sensing and compensation system of the display device according to the present embodiments.

The above-described compensation system, in which each of the plurality of sensors 200 is included in the corresponding data driver IC and the sensing data acquirer 320 and the compensator 340 are included in the timing controller 140, is illustrated again in FIG. 4.

FIG. 4 is another block diagram illustrating the sensing and compensation system of the display device 100 according to the present embodiments.

Referring to FIG. 4, the sensing and compensation system of the display device 100 includes N number of data driver ICs DIC #1 . . . DIC #K . . . DIC #M . . DIC #N, each of which includes a corresponding one of the N number of sensors 200 (SU #1 . . . SU #K . . . SU #M . . . SU #N), and the timing controller 140 including the sensing data acquirer 320 and the compensator 340.

Referring to FIG. 4, each of the number of data driver ICs DIC #1 to DIC #N is implemented as a chip-on-film IC connected between the bonding pads of a source board (also referred to as a source printed circuit board (source PCB)) 410 and the bonding pads of the display panel 110.

Referring to FIG. 4, the timing controller 140 (T-Con) is mounted on a control board (also referred to as a control PCB) 420.

Referring to FIG. 4, the source board 410 and the control board 420 are connected by means of a flexible cable 430, such as a flexible printed circuit (FPC), thereby electrically connecting the N number of data driver ICs DIC #1 to DIC #N and the timing controller 140.

As for the sensing and compensation system is configured as in FIG. 4, the internal configuration of the timing controller 140 will be described with reference to FIG. 3.

Referring to FIG. 3, timing controller 140 includes a receiver 310 receiving data from each of the N number of data driver ICs DIC #1 to DIC #N, the sensing data acquirer 320 acquiring sensing data from data received from the N number of data driver ICs DIC #1 to DIC #N in response to a synchronized clock signal, and the compensator 340 performing a compensation process based on the sensing data acquired by the sensing data acquirer 320.

The synchronized clock signal is a clock signal, the clock edge of which evades the entire transition periods of the data received from the N number of data driver ICs DIC #1 to DIC #N.

As described above, the timing controller 140 can ordinarily and reliably acquire the sensing data contained in the Data sequentially transmitted from the N number of data driver ICs DIC #1 to DIC #N using the data Data sequentially transmitted from the N number of data driver ICs DIC #1 to DIC #N and the "synchronized clock signal." The timing controller 140 can ordinarily and reliably provide the compensation function, thereby preventing image defects, such as image insensitiveness, non-uniform luminance, and gradation abnormality.

Due to different lengths of the data transmission paths between the N number of data driver ICs DIC #1 to DIC #N and the timing controller 140, environmental noise, or differences among the N number of data driver ICs DIC #1 to DIC #N, the data received from the N number of data driver ICs DIC #1 to DIC #N may have different phases. That is, the data received from the N number of data driver ICs DIC #1 to DIC #N may have different transition periods.

Thus, when the timing controller 140 receives and acquires the data Data sequentially transmitted from the N number of data driver ICs DIC #1 to DIC #N using a single clock signal, at least one portion of the data Data sequentially transmitted from the N number of data driver ICs DIC #1 to DIC #N may not be synchronized with the single clock signal. Consequently, the timing controller 140 may not properly acquire the sensing data from at least one portion of the data Data sequentially transmitted from the N number of data driver ICs DIC #1 to DIC #N using a single clock signal.

In contrast, the present embodiments acquire the sensing data by receiving the data Data sequentially transmitted from the N number of data driver ICs DIC #1 to DIC #N using the data Data sequentially transmitted from the N number of data driver ICs DIC #1 to DIC #N and the "synchronized clock signal." Thus, even in the case in which the data received from the N number of data driver ICs DIC #1 to DIC #N have different phases, i.e., even in the case in which the data received from the N number of data driver ICs DIC #1 to DIC #N have different transition periods, it is possible to ordinarily and reliably acquire all sensing data. Accordingly, it is possible to ordinarily and reliably perform the compensation, thereby preventing image defects, such as image insensitiveness, non-uniform luminance, and gradation abnormality.

Referring to FIG. 4, each of the N number of data driver ICs DIC #1 to DIC #N transmits data having a low voltage differential signal (LVDS) structure to the timing controller 140. The present embodiments may employ Bus LVDS among the LVDS.

Here, an LVDS system is an electrical signal system, in which each of the N number of data driver ICs DIC #1 to DIC #N corresponding to a transmitter transmits two different voltages having the LVDS structure, and the timing controller 140 corresponding to a receiver compares the two voltage signals. The LVDS system uses the difference in the voltage between two signal lines in data coding.

Since each of the N number of data driver ICs DIC #1 to DIC #N transmits data having the LVDS structure through an LVDS cable as described above, the amplitude of the LVDS is small and the two electrical lines are electromagnetically coupled in an appropriate manner. Accordingly, electromagnetic noise and resultant power consumption are reduced, and high-speed data transmission is possible.

Figure 5:
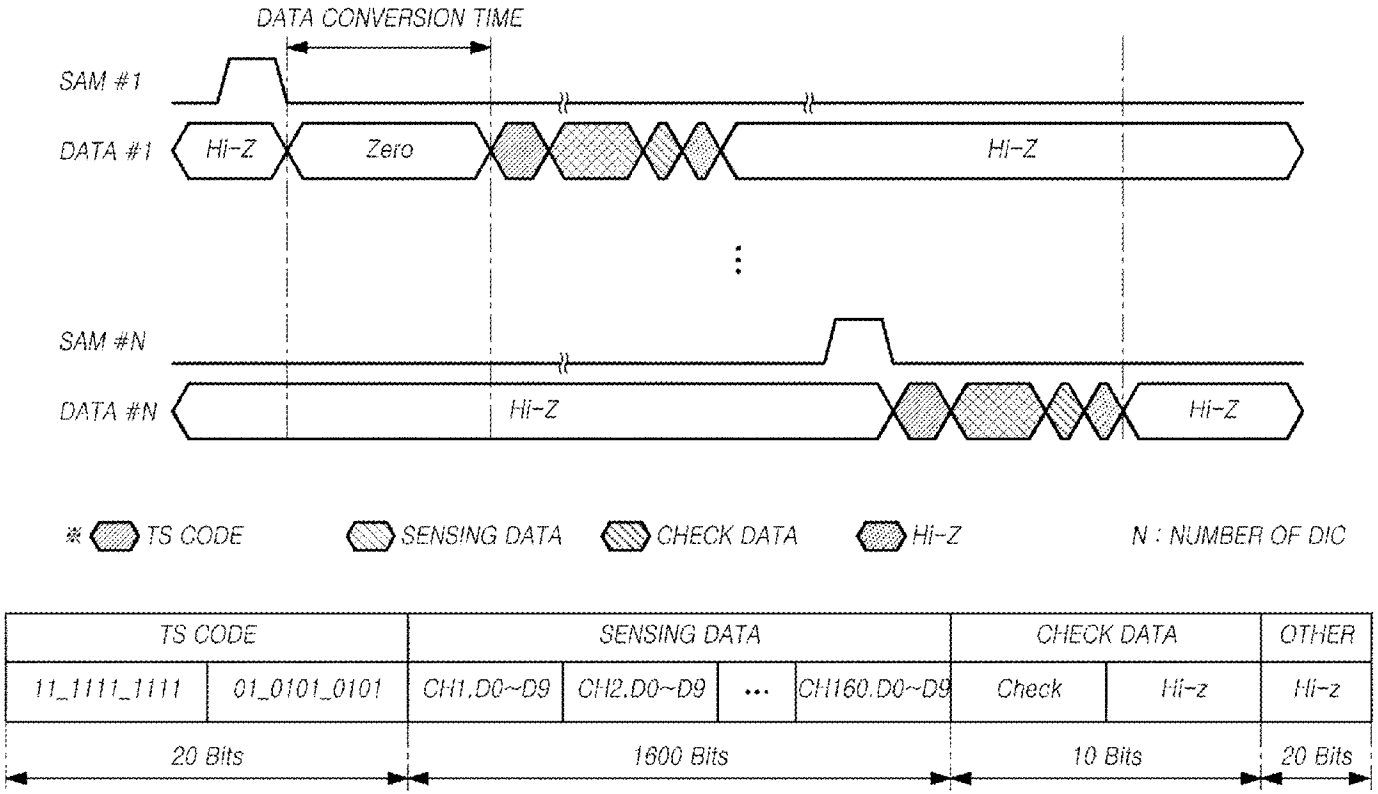
FIG. 5 illustrates an LVDS structure of data transmitted from each of the plurality of sensors in the display device according to the present embodiments.

FIG. 5 illustrates an LVDS structure of data transmitted from each of the plurality of sensors 200 in the display device 100 according to the present embodiments.

Referring to FIG. 5, in the display device 100 according to the present embodiments, the N number of sensors 200 included in the N number of data driver ICs DIC #1 to DIC #N transmit data having an LVDS structure, as described above.

Referring to FIG. 5, the timing controller 140 transmits sampling start signals SAM #1 to SAM #N to the N number of data driver ICs DIC #1 to DIC #N.

Then, each of the N number of sensors 200 included in data driver ICs DIC #1 to DIC #N senses a voltage of a sensing node in order to sense the unique characteristics, such as a threshold voltage and mobility, of the driving transistor DT disposed on the corresponding subpixel, in response to the corresponding sampling start signal among the sampling start signals SAM #1 to SAM #N, samples the sensed voltage, generates sensing data through data conversion of the sampled voltage into a digital format, and sequentially transmits data having an LVDS structure including the generated sensing data to the timing controller 140.

Referring to FIG. 5, the data having the LVDS structure includes, for example, the sensing data, a transfer start (TS) code attached to the head portion of the sensing data, and check data attached to the tail portion of the sensing data.

Referring to FIG. 5, each of the N number of data driver ICs DIC #1 to DIC #N notifies that the sensing data will be sent by transmitting the TS code. The TS code may be composed of, for example, 20 bits.

Referring to FIG. 5, after the transmission of the sampling start signals SAM #1 to SAM #N, the timing controller 140 remains in a wait mode during the sensing operation performed by each of the N number of data driver ICs DIC #1 to DIC #N, until the TS code is received.

Referring to FIG. 5, the sensing data is digital data that the sensor 200 included in each of the N number of data driver ICs DIC #1 to DIC #N generates by converting the voltage sensed through a plurality of sensing channels into a digital format.

In the case of FIG. 5, each of the sensors 200 has 160 sensing channels (i.e., 160 sensing lines), and generates sensing data corresponding to 10 bits through a single sensing channel. In this case, the sensing data is composed of 1600 bits.

Referring to FIG. 5, the check data on the tail portion of the sensing data are bits provided for an overflow checking function or a checksum function.

Each of the sensors 200 transmits the sensing data by attaching the TS code to the head portion and the check data to the tail portion, allowing the timing controller 140 to recognize the start of the sensing data in the data transmitted from each of the sensors 200 and determine whether the sensing data is successfully received.

When the timing controller 140 transmits the sampling start signals as described above, each of the data driver ICs sequentially transmits the data having the LVDS structure to the timing controller 140.

Here, the sampling start signals arrive at high levels at different points in time in each of the data driver ICs, and the data including the sensing data are transmitted to the timing controller 140 through conductive lines having different lengths.

For example, at the high level of SAM #1, DIC #1 generates sensing data and transmits data including the sensing data. Subsequently, at the high level of SAM #2, DIC #2 generates sensing data and transmits data including the sensing data. In this manner, the entire data driver ICs DIC #1 to DIC #N sequentially transmit data including the sensing data.

However, a timing of data transmitted from a data driver IC is different from a timing of data transmitted from another data driver IC. Moreover, the data transmitted from the data driver ICs are transmitted through the conductive lines having different lengths. Thus, the data transmitted from the data driver ICs may have different phases.

Figure 6:
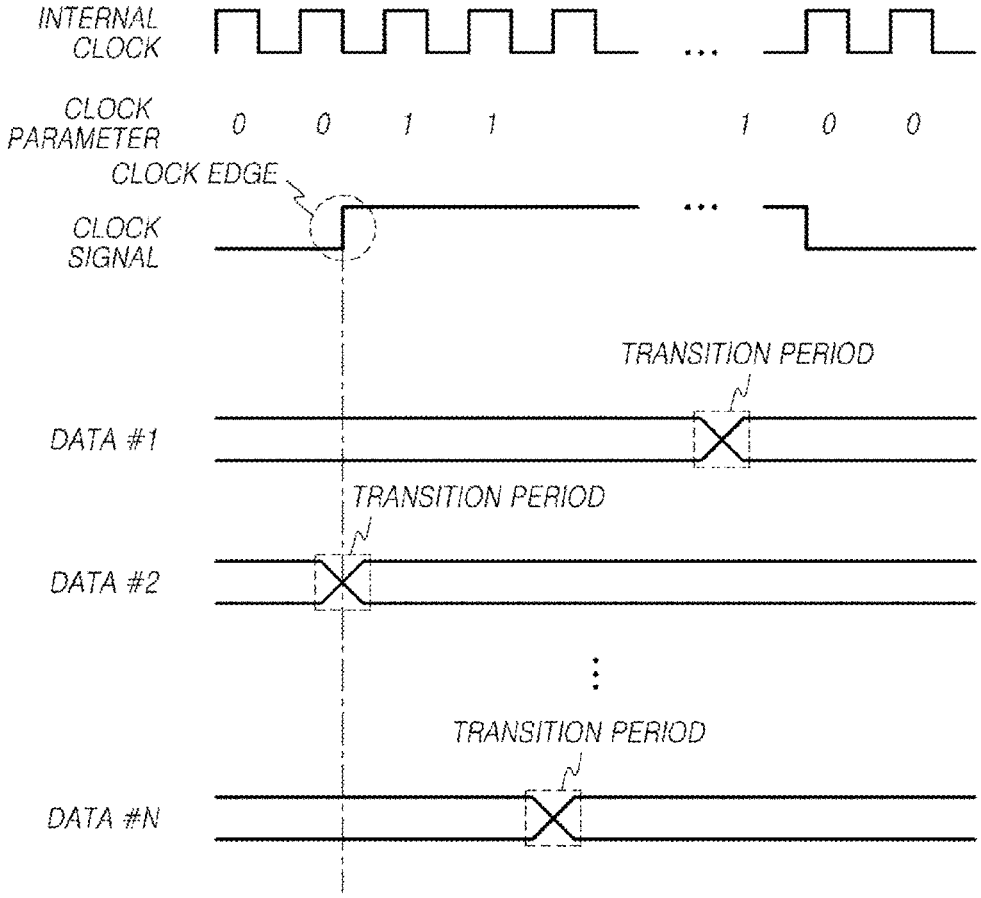
FIG. 6 illustrates a clock signal unsynchronized with data in the display device according to the present embodiments.
Figure 7:
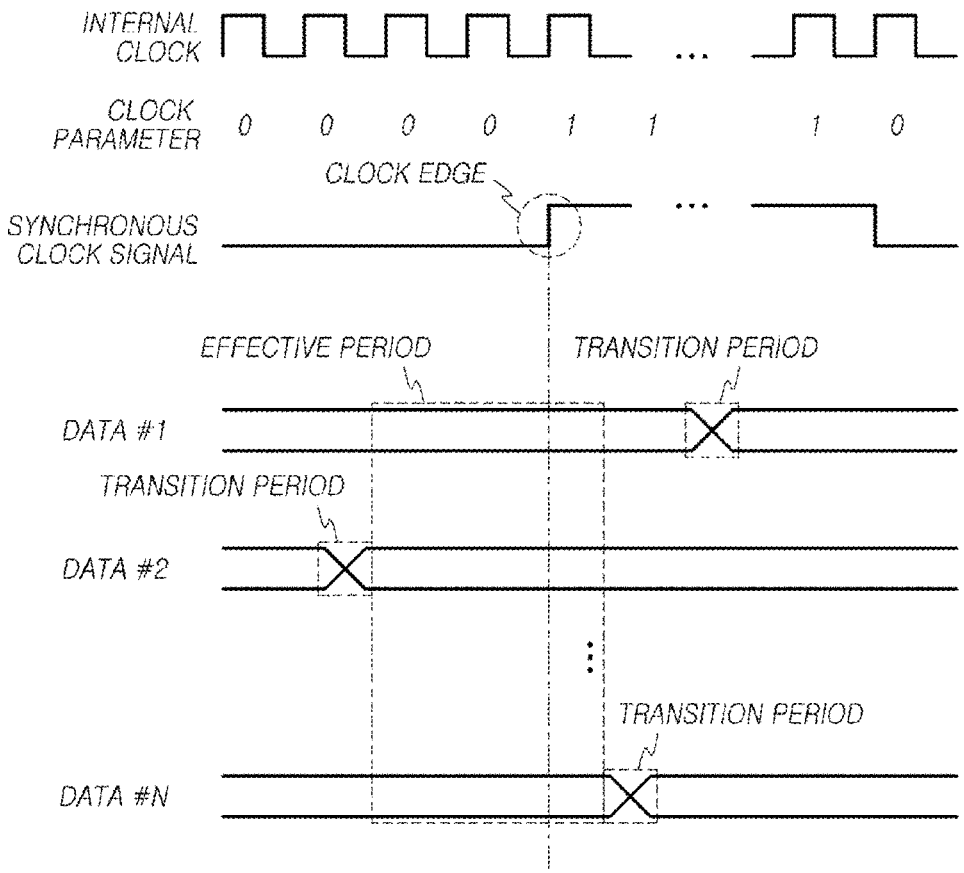
FIG. 7 illustrates a clock signal synchronized with data in the display device according to the present embodiments.

Referring to FIG. 6 and FIG. 7 illustrating data having an LVDS structure, data transmitted from the data driver ICs have different phases. That is, the data transmitted from the data driver ICs have different transition periods.

As described above, the sensing data acquirer 320 in the timing controller 140 cannot properly acquire the sensing data in the data transmitted from each of the data driver ICs, i.e., each of the sensors 200, unless the data transmitted from each of the data driver ICs is in the stable status.

Here, the stable status of the data indicates that no clock edge of the clock signal is present in the transition period of the data transmitted from each of the data driver ICs. The transition period is the period in which a data value is underdetermined (i.e., neither "0" nor "1").

The clock signal having the clock edge evading the transition period of the data transmitted from each of the data driver ICs is referred to as a "clock signal synchronized with the corresponding data."

In order to properly compensate for characteristics variations of circuit components in the display panel 110, a clock signal having a clock edge able to evade the transition periods of the entire data transmitted from the entire data driver ICs is implemented.

As illustrated in FIG. 6, a clock signal having a clock edge in a transition period of at least one portion of data Data #2 among N number of portions of data Data #1 to Data #N transmitted from the N number of data driver ICs DIC #1 to DIC #N may be used for sensing. That is, the clock signal that is not synchronized with at least one portion of data Data #2 is used for sensing. However, the sensing data acquirer 320 in the timing controller 140 cannot correctly recognize the corresponding data Data #2, because the clock edge is in transition period, thereby failing to properly acquiring the sensing data. In some cases, none of the sensing data contained in the corresponding data Data #2 and the other data Data #1, Data #3 . . . Data #N may be properly acquired.

Therefore, as illustrated in FIG. 7, the clock signal used during acquisition of the sensing data have a clock edge that evades the entire transition periods of the N number of portions of data Data #1 to Data #N transmitted from the N number of data driver ICs DIC #1 to DIC #N. That is, the clock signal used during acquisition of the sensing data has a clock signal synchronized with all data.

Referring to FIG. 7, when the clock edge of the clock signal evades the entire transition periods of the N number of portions of data Data #1 to Data #N transmitted from the N number of data driver ICs DIC #1 to DIC #N, a predetermined period of time before and after the clock edge is an effective period in which the sensing data can be ordinarily acquired from of the N number of portions of data Data #1 to Data #N.

Accordingly, the display device 100 according to the present embodiments further includes a synchronization controller 330 generating a synchronized clock signal having a clock edge evading the entire transition periods of the N number of portions of data Data #1 to Data #N transmitted from the N number of data driver ICs DIC #1 to DIC #N.

The synchronization controller 330 generates clock signals using an internal clock and a clock parameter. The synchronization controller 330 generates a clock signal having a clock edge evading the transition periods of the entire data sequentially transmitted from the number of sensors 200 as a synchronized clock signal.

The synchronization controller 330 can prevent any asynchronous state between the data sequentially transmitted from the plurality of sensors 200 and the clock signal used for acquiring the sensing data from the sequentially-transmitted data. Consequently, it is possible to ordinarily acquire all of the sensing data regardless of differences in the transition period among data sequentially transmitted from the plurality of sensors 200, thereby successfully performing the compensation process.

The synchronization controller 330 can generate a synchronized clock signal by finding a clock parameter with which the TS codes of the data sequentially transmitted from the plurality of sensors 200 can be recognized.

As described above, the synchronization controller 330 can efficiently generate the clock signal synchronized with the entire data sequentially transmitted from the plurality of sensors 200 by changing the clock parameter when generating the synchronized clock signal.

Hereinafter, the method of generating the synchronized clock signal will be described in greater detail.

When the recognition of the TS code of the data sequentially transmitted from the plurality of sensors 200 based on a clock signal reference is succeeded, the sensing data acquirer 320 acquires the sensing data of the data sequentially transmitted from the plurality of sensors 200.

Then, the synchronization controller 330 iteratively generates clock signals while shifting the clock parameter by predetermined bits (e.g. 1 bit, 2 bits, or the like) until the recognition of all of the TS codes sequentially transmitted from the plurality of sensors 200 is succeeded, thereby finally generating a synchronized clock signal.

As described above, the synchronization controller 330 finds the synchronized clock signal by shifting the clock parameter by the predetermined bits such that all of the TS codes of the data are recognizable when generating the clock signal synchronized with the entire data sequentially transmitted from the plurality of sensors 200. It is therefore possible to efficiently control synchronization with a high rate of success.

The method of generating the synchronized clock signal will be described again in terms of the timing between the transition periods of data and the clock edge of the clock signal.

When the clock signal is the synchronized clock signal, the sensing data acquirer 320 acquires the corresponding sensing signal by recognizing the TS codes of the data sequentially transmitted from the plurality of sensors 200.

The synchronization controller 330 determines whether or not the clock edge of the clock signal evades the transition periods of the entire data sequentially transmitted from the plurality of sensors 200, and when it is determined that the clock edge of the clock signal does not evade the transition period of the data transmitted from at least one sensor 200, iteratively generates clock signals by shifting the clock parameter by predetermined bits until the clock edge of a clock signal evades the entire transition periods sequentially transmitted from the plurality of sensors 200, thereby finally generating a synchronized clock signal.

As described above, the synchronization controller 330 finds the synchronized clock signal by shifting the clock parameter by predetermined bits until finding a clock signal, the clock edge of which evades the entire transition periods sequentially transmitted. In this manner, the synchronization controller 330 can generate the clock signal synchronized with the entire data sequentially transmitted from the plurality of sensors 200, thereby efficiently performing synchronization control with a high rate of success.

When the synchronized clock signal is generated by the above-described method of generating the synchronized clock signal, the synchronized clock signal is generated by shifting the clock parameter by predetermined bits. Here, the number of bits may vary depending on at least one set information of, for example, a compensation time and the accuracy of compensation.

When the number of bits by which the clock parameter is shifted is increased, the synchronized clock signal can be found more rapidly. This can advantageously reduce a sensing data acquisition time and a compensation time. However, the possibility of failing to find the synchronized clock signal may increase.

As described above, it is possible to perform synchronization control under desired conditions (time or accuracy) by varying the number of bits by which the clock parameter is shifted, depending on the set information of at least one of the sensing data acquisition time, the compensation time, and the accuracy of sensing data acquisition.

Figure 8:
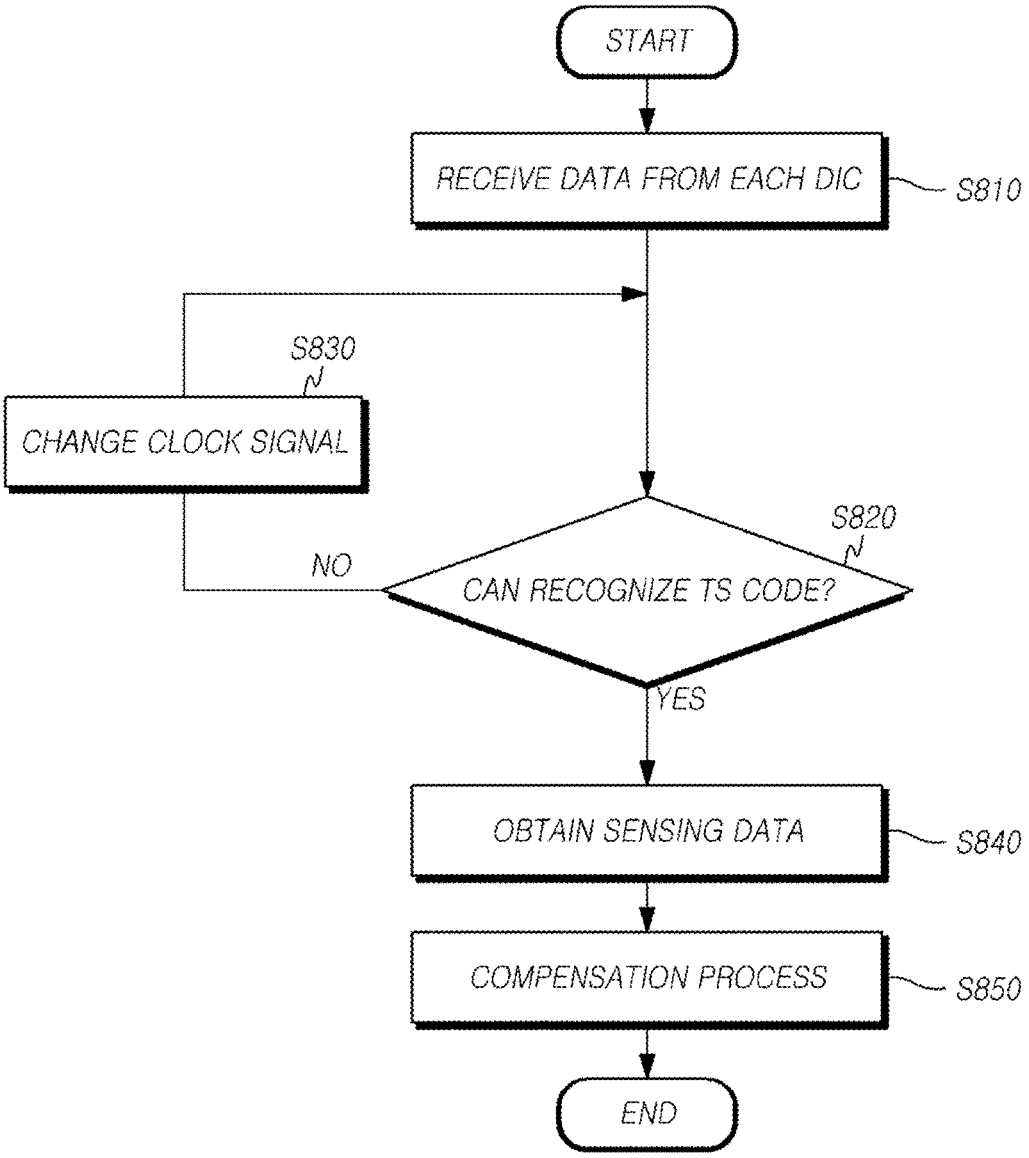
FIG. 8 is a flowchart illustrating a method of driving the display device according to the present embodiments.

FIG. 8 is a flowchart illustrating a method of driving the display device 100 according to the present embodiments.

Referring to FIG. 8, the method of driving the display device 100 according to the present embodiments includes the following operations. At operation S810, the timing controller 140 receives data from the plurality of data driver ICs. At operation S820, the timing controller 140 determines whether or not a TS code is recognizable from the data received from the plurality of data driver ICs, using a clock signal. At operation S830, when the TS code is determined to be unrecognizable, the timing controller 140 changes clock signals until the TS code is recognizable. At operation S840, when the TS code is determined to be recognizable, the timing controller 140 acquires sensing data from the data received from the plurality of data driver ICs.

At the operation S830 above, the timing controller 140 generates clock signals using an internal clock and a clock parameter. The timing controller 140 changes clock signals used in the recognition of the TS codes by generating new clock signals by shifting the clock parameter by predetermined bits (see FIG. 10).

As described above, the driving method generates the clock signal synchronized with the entire data sequentially transmitted from the plurality of data driver ICs, i.e., the plurality of sensors 200. The driving method finds the synchronized clock signal by changing clock signals by shifting the clock parameter by predetermined bits such that the TS codes of the entire data can be recognized. It is therefore possible to efficiently perform synchronization control with a high rate of success.

Figure 9:
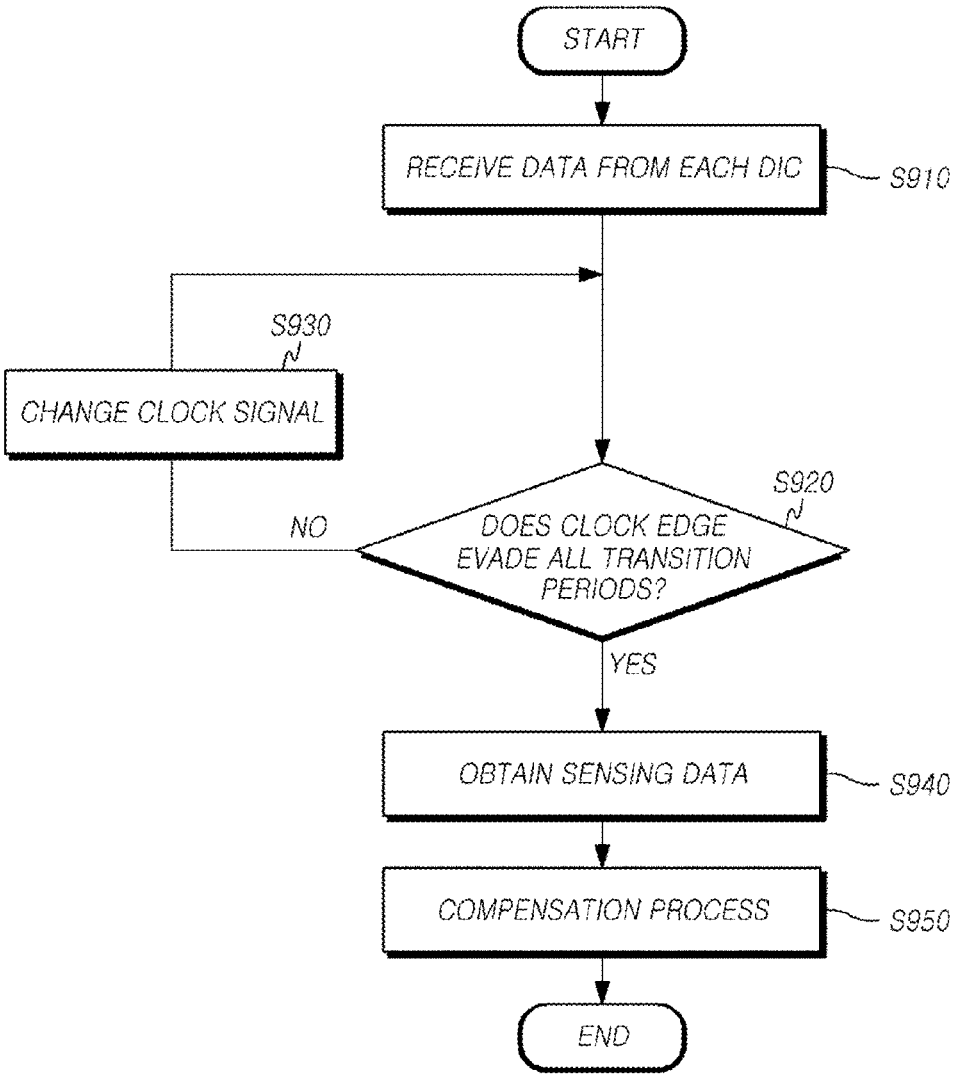
FIG. 9 is a flowchart illustrating another method of driving the display device according to the present embodiments.

FIG. 9 is a flowchart illustrating another method of driving the display device 100 according to the present embodiments.

Referring to FIG. 9, the method of driving the display device 100 according to the present embodiments includes the following operations. At operation S910, the timing controller 140 receives data from the plurality of data driver ICs. At operation S920, the timing controller 140 determines whether or not a clock edge of a clock signal evades all of transition periods of the data received from the plurality of data driver ICs. At operation S930, when it is determined that the clock edge of the clock signal does not evade the transition period of the data received from at least one data driver IC among the plurality of data driver ICs, the timing controller 140 changes the clock signal such that the clock edge of the clock signal evades the transition periods of the entire data received from the plurality of data driver ICs. At operation S940, when it is determined that the clock edge of the clock signal evades the transition periods of the entire data received from the plurality of data driver ICs, the timing controller 140 acquires sensing data from the data received from the plurality of data driver ICs. At operation S950, the timing controller 140 performs a compensation process based on the sensing data.

Figure 10:
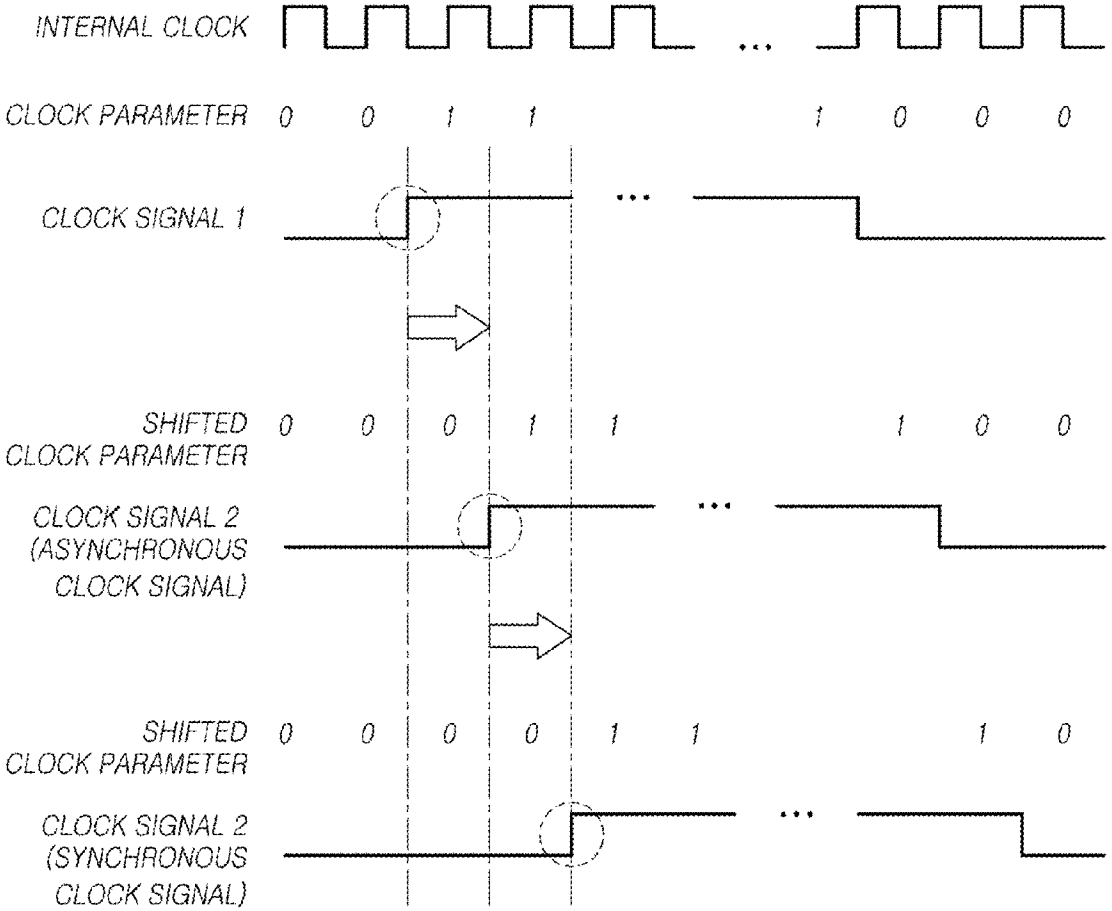
FIG. 10 illustrates a method of generating data and a synchronized clock signal in the method of driving the display device according to the present embodiments.

At the operation S930 above, the timing controller 140 changes clock signals using an internal clock and a clock parameter by shifting the clock parameter by predetermined bits (see FIG. 10).

As described above, the driving method generates the clock signal synchronized with the entire data sequentially transmitted from the plurality of data driver ICs, i.e., the plurality of sensors 200. The driving method finds the synchronized clock signal by changing clock signals by shifting the clock parameter by predetermined bits such that the clock edge evades the transition periods of the entire data. It is therefore possible to efficiently perform synchronization control with a high rate of success.

FIG. 10 illustrates a method of generating data and a synchronized clock signal in the method of driving the display device 100 according to the present embodiments.

Referring to FIG. 10, this method changes the unsynchronized clock signal illustrated in FIG. 6 to the synchronized clock signal illustrated in FIG. 7 by shifting a clock parameter by 1 bit.

Referring to FIG. 10, it is apparent that the clock edge is shifted by 1 bit when the clock parameter is shifted by 1 bit. In this manner, it is possible to find a clock edge evading the transition periods of the entire data.

According to the present embodiments as set forth above, it is possible to prevent image defects, such as image insensitiveness, non-uniform luminance, and gradation abnormality, which would otherwise occur when sensing data are not ordinarily acquired from data sequentially transmitted from the plurality of sensing configurations. Here, the plurality of sensing configurations may be the plurality of data driver ICs including the plurality of sensors 200, the plurality of ADCs in which the plurality of sensors 200 are embodied, or the plurality of sensors 200 implemented as the plurality of ADCs.

In addition, according to the present embodiments, even in the case in which data sequentially transmitted from the plurality of sensing configurations have phase differences, it is possible to ordinarily acquire sensing data from the data sequentially transmitted from the plurality of sensing configurations, thereby successfully performing compensation.

Furthermore, according to the present embodiments, it is possible to ordinarily acquire sensing data from data sequentially transmitted from the plurality of sensing configurations using a clock signal synchronized with the entire data sequentially transmitted from the plurality of sensing configurations, thereby successfully performing compensation.

In addition, according to the present embodiments, it is possible to reliably generate a synchronized clock signal by shifting a clock parameter by a predetermined bit, whereby the clock signal synchronized with entire data sequentially transmitted from the plurality of sensing configurations is generated.

The foregoing descriptions and the accompanying drawings have been presented in order to explain the certain principles of the present disclosure. A person skilled in the art to which the disclosure relates can make many modifications and variations by combining, dividing, substituting for, or changing the elements without departing from the principle of the present disclosure. The foregoing embodiments disclosed herein shall be interpreted as illustrative only but not as limitative of the principle and scope of the present disclosure. It should be understood that the scope of the present disclosure shall be defined by the appended Claims and all of their equivalents fall within the scope of the present disclosure.

What is claimed is:

1. A display device comprising:

a plurality of sensors each sequentially transmitting data including a transfer start code and sensing data;

a sensing data acquirer configured to receive the data sequentially transmitted from each of the plurality of sensors in response to a synchronized clock signal and acquire the sensing data from the received data; and a compensator configured to determine an amount of video data to be compensated based on the sensing data and compensate the video data to be supplied to each of subpixels according to the determined amount to be compensated, wherein the synchronized clock signal has a clock edge evading entire transition periods of the data sequentially transmitted from the plurality of sensors.

2. The display device according to claim 1, wherein each of the plurality of sensors comprises an analog-to-digital converter included in each of a plurality of data driver integrated circuits, wherein the sensing data acquirer and the compensator are included in a timing controller, and wherein each of the plurality of sensors transmits the data in a form of analog-to-digital conversion data to the timing controller.

3. The display device according to claim 2, wherein each of the plurality of data driver integrated circuits transmits the data having a low voltage differential signal structure to the timing controller.

4. The display device according to claim 2, wherein each of the plurality of sensors samples a voltage of a sensing node within a circuit of a corresponding subpixel in response to a sampling start signal, converts the sampled voltage into digital bits, and generates the analog-to-digital conversion data.

5. The display device according to claim 1, wherein each of the data includes the sensing data, a transfer start code attached to a head portion of the sensing data, and check data attached to a tail portion of the sensing data.

6. The display device according to claim 1, further comprising a synchronization controller generating a clock signal based on an internal clock and a clock parameter, wherein the synchronization controller generates a clock signal, a clock edge of which evades the entire transition periods of the data sequentially transmitted from the plurality of sensors, as the synchronized clock signal.

7. The display device according to claim 6, wherein the synchronization controller generates the synchronized clock signal by finding the clock parameter, with which the transfer start codes of the data sequentially transmitted from the plurality of sensors are recognizable, by shifting the clock parameter by a predetermined bit.

8. The display device according to claim 6, wherein the synchronization controller generates the synchronized clock signal by finding the clock edge evading the entire transition periods of the data sequentially transmitted from the plurality of sensors by shifting the clock parameter by a predetermined bit.

9. The display device according to claim 8, wherein the bit by which the clock parameter is shifted varies depending on set information of at least one of a sensing data acquisition time, a compensation time, and an accuracy of sensing data acquisition.

10. The display device according to claim 7, wherein the bit by which the clock parameter is shifted varies depending on set information of at least one of a sensing data acquisition time, a compensation time, and an accuracy of sensing data acquisition.

11. A method of driving a display device comprising:

receiving data from each of a plurality of data driver integrated circuits;

determining whether or not a transfer start code in the data received from each of the plurality of data driver integrated circuits is recognizable;

responsive to determining that the transfer start code is not recognizable, changing a clock signal until the transfer start code is recognizable;

responsive to determining that the transfer start code is recognizable, acquiring sensing data from the data received from each of the plurality of data driver integrated circuits;

determining an amount of video data to be compensated based on the sensing data; and compensating the video data to be supplied to each of subpixels according to the determined amount to be compensated.

12. The method according to claim 11, wherein the clock signal is changed while a clock parameter is being shifted by a predetermined bit.

13. A method of driving a display device comprising:

receiving data from a plurality of data driver integrated circuits;

determining whether or not a clock edge of a clock signal evades entire transition periods of the data received from the plurality of data driver integrated circuits;

responsive to determining that the clock edge of the clock signal is present in the transition period the data received from at least one data driver integrated circuit among the plurality of data driver integrated circuits, changing the clock signal such that a clock edge thereof evades the entire transition periods of the data received from the plurality of data driver integrated circuits;

responsive to determining that the clock edge of the clock signal evades the entire transition periods of the data received from the plurality of data driver integrated circuits, acquiring sensing data from the data received from the plurality of data driver integrated circuits;

determining an amount of video data to be compensated based on the sensing data; and compensating the video data to be supplied to each of subpixels according to the determined amount to be compensated.

14. The method according to claim 13, wherein the clock signal is changed while a clock parameter is being shifted by a predetermined bit.

15. A timing controller comprising:

a receiver receiving data from a plurality of data driver integrated circuits;

a sensing data acquirer configured to receive the data received from the plurality of data driver integrated circuits in response to a synchronized clock signal and acquire the sensing data from the received data; and a compensator configured to determine an amount of video data to be compensated based on the sensing data acquired by the sensing data acquirer and compensate the video data to be supplied to each of subpixels according to the determined amount to be compensated wherein the synchronized clock signal has a clock edge evading entire transition periods of the data sequentially transmitted from the plurality of data driver integrated circuits.

* * * * *